US005141198A

United States Patent [19]

Hoyt

[11] Patent Number: 5,141,198

[45] Date of Patent: Aug. 25, 1992

[54] APPARATUS FOR STEADYING ONE'S ARM AT AN EASEL AND USE THEREOF

[76] Inventor: Marion E. Hoyt, R.D. #1, Box 426, County Rte. 11, Cobleskill, N.Y. 12043

[21] Appl. No.: 748,683

[22] Filed: Aug. 22, 1991

[51] Int. Cl.[5] ..... A47B 19/00

[52] U.S. Cl. ..... 248/441.1; 248/460

[58] Field of Search ..... 248/441.1, 454, 455, 248/460, 461, 462, 463, 464, 465; 294/19.1; D19/35; 434/84

[56] References Cited

U.S. PATENT DOCUMENTS

| | | | |
|---|---|---|---|
| Re. 20,737 | 5/1938 | Kehl | 294/19.1 X |
| 281,591 | 7/1883 | Werner | 248/463 |
| 289,700 | 12/1883 | Parker | 248/441.1 |
| 294,941 | 3/1884 | Werner | 248/463 |
| 306,188 | 10/1884 | Strong | 294/19.1 X |
| 1,628,030 | 5/1927 | Catlett . | |
| 2,496,276 | 2/1950 | Dolas . | |
| 2,950,890 | 8/1960 | Hough, Jr. . | |
| 3,101,568 | 8/1963 | Tratt . | |
| 3,815,856 | 6/1974 | Cortimilia . | |
| 3,972,133 | 8/1976 | Parshall | 248/441.1 X |
| 4,088,290 | 5/1978 | Novello . | |
| 5,005,795 | 4/1991 | Holmgren | 248/455 X |
| 5,060,995 | 10/1991 | Goldstein | 294/19.1 |

FOREIGN PATENT DOCUMENTS

| | | | |
|---|---|---|---|
| 1050431 | 1/1954 | France | 248/461 |
| 7456 | of 1896 | United Kingdom . | |

*Primary Examiner*—J. Franklin Foss

*Attorney, Agent, or Firm*—Heslin & Rothenberg

[57] ABSTRACT

The subject invention provides an apparatus for steadying one's arm at an easel which comprises a rod like support member two ends covered by plastic caps. A hook is provided at one end of the support member for attaching the apparatus to an easel. The hook is attached to an eyelet located on top of the easel so that the apparatus, when the other end of the support member is supported by one of an artist's hands, steadies the other of said artist's hands which rests upon the support member.

2 Claims, 1 Drawing Sheet

APPARATUS FOR STEADYING ONE'S ARM AT AN EASEL AND USE THEREOF

FIELD OF THE INVENTION

The subject invention relates to an apparatus for steadying one's arm at an easel.

BACKGROUND OF THE INVENTION

A maulstick is a well known device used by artists to rest and thus steady their working hand while they are painting or drawing at an easel. The ordinary maulstick is simply a small diameter, straight wooden stick having a rubber tip at one end. The rubber tipped end of the stick is held against the artist's working surface, such as a canvas, by force applied by the artist's nonworking hand while gripping the opposite end of the maulstick. The artist's working hand is rested on an intermediate portion of the stick as he works.

Although the conventional maulstick described may be satisfactory for professional artists who are skilled and familiar with its use, it is generally unsatisfactory for most amateur artists and particularly older artists whose hands are not as steady or as strong as they once were.

Substantial effort and skill are required for an artist to hold the rubber tipped end of the maulstick firmly against the work surface with one hand while painting or drawing with the other hand resting on the stick. Any slippage of the rubber tipped end over the working surface is likely to result in a smear or smudge on the work or an unintentional stroke of the brush, pen or other drawing instrument.

Consequently, there is a distinct need for an apparatus for steadying one's arm at an easel that will enable an artist to support easily the apparatus with a minimum of effort and without danger of causing imperfections in his work while his working hand rests on the apparatus.

SUMMARY OF THE INVENTION

Accordingly, a principle object of the present invention is to provide an apparatus for steadying one's arm at an easel.

It is a further object to provide such an apparatus which is easy to use and inexpensive.

It is a further object to provide such an apparatus which does not need to be assembled due to its one-piece construction.

The main components of the subject invention include a support member having two ends. The support member may be a rod made of wood or plastic, or any other suitable shape or material such that the support member is sturdy and of sufficient length to reach from the top of the easel to the position where an artist's hand holds the other end of the support member. The support member must also be of suitable dimensions and material such that it is easy to use.

A hook means is located at one end of the support member. The hook means is capable of being inserted into an eyelet. Preferably, the hook means comprises a hook.

In its use, the apparatus provides a method of steadying an arm at an easel. The apparatus is attached to the top of the easel using the hook means located at one end of the support member. By inserting the hook means into an eyelet located on top of the easel, the apparatus is attached and the artist then holds the opposite end of the support member in his other hand. The arm of the drawing hand is then steadied by placing it upon the support member.

BRIEF DESCRIPTION OF THE FIGURES

These and other objects, features and advantages of this invention will be evident from the following detailed description of one preferred embodiment when read in conjunction with the accompanying drawings in which.

DETAILED DESCRIPTION OF THE INVENTION

Figure 1:
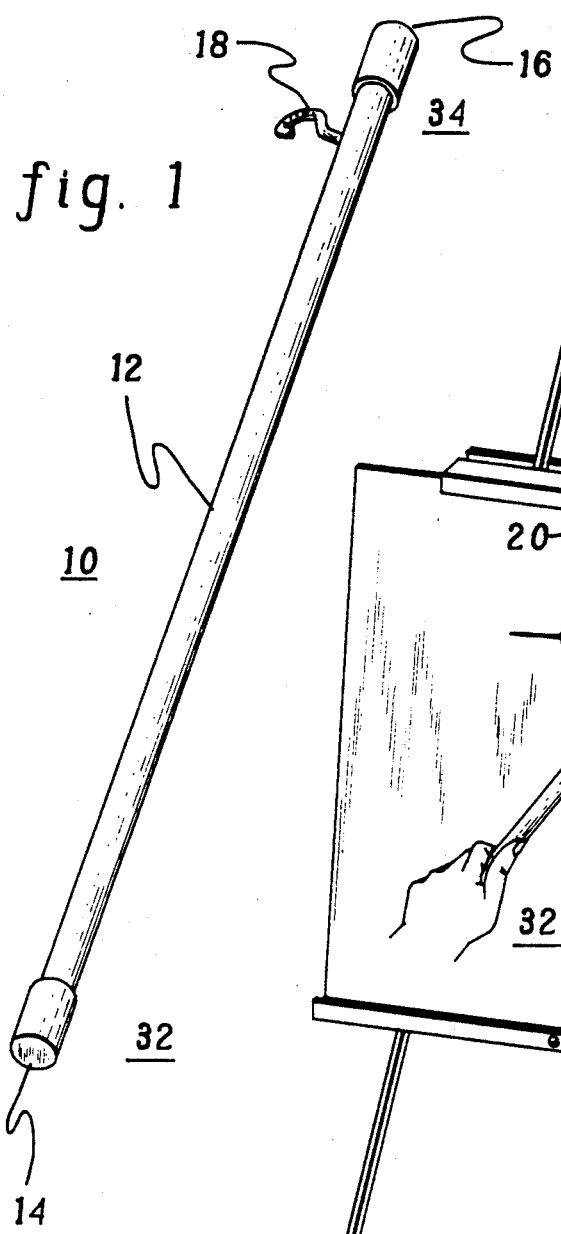
FIG. 1 is a perspective view of one embodiment of the apparatus of the subject invention.

The main components of one preferred embodiment of the subject invention are depicted in FIG. 1. FIG. 1 illustrates the device 10 which comprises a support member 12 having two ends 32,34. Each end is covered with a plastic cap 14,16. The plastic cap protects the artist and the artist's materials from the edges of the end of the support member. For example, if the support member is made of wood, sharp edges or shavings from the wood where it has been cut are covered by the plastic caps 14,16. The support member is approximately ½" in diameter and about 23 9/16" long. When the plastic end caps, which are approximately 1 ⅛" long, are placed over the ends of the apparatus, the entire device with the caps placed on the support member is about 24 5/16" long.

Near the plastic cap 16 on one end 34 of the support member 12 is a hook means 18 capable of being inserted into an eyelet. The hook means is a regular hook of about ½" diameter. The hook 18 protrudes from the support member 12 approximately 15/16" and is placed about 1 ⅜" from the end of the support member 12.

Figure 2B:
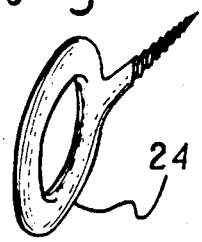
FIG. 2*a–b* is a perspective view of the use of the apparatus shown in FIG. 1.
Figure 2A:
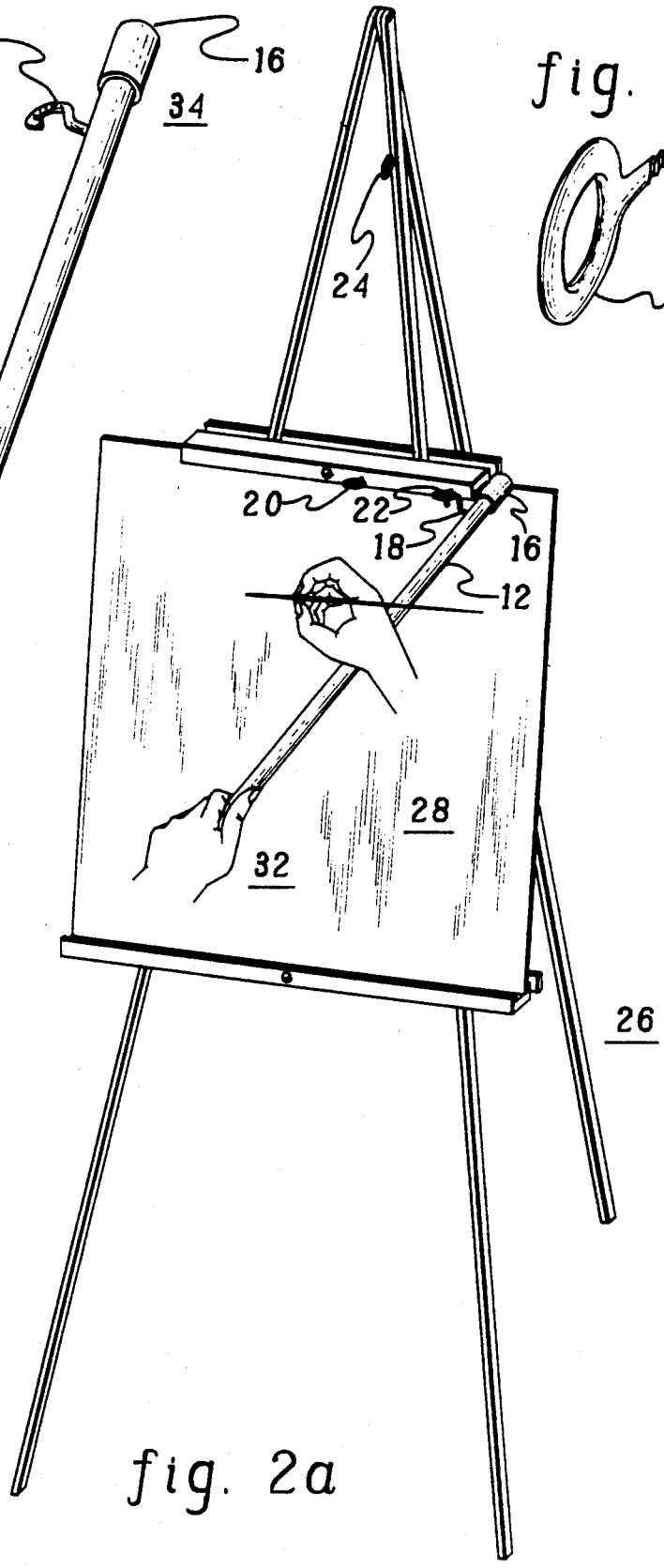

In its operation, the hook 18 is inserted into an eyelet. The eyelet 22 is positioned on an easel 26 as best shown in FIG. 2. Eyelets 20, 22, and 24 are positioned on the easel 26, with eyelet 24 being most useful for attaching the apparatus for storage. The eyelets as shown in FIG. 2 are positioned for an artist who preferably paints or draws right-handed. For an artist who paints or draws left-handed, eyelet 24 would preferably be on the top left portion of the easel, and eyelet 22 would be positioned to the extreme left of eyelet 20. This positioning allows a left-handed artist to easily and comfortably access all areas of the canvas.

After the hook 18 has been inserted into the eyelet 22 as shown in FIG. 2, one of the artist's hands is used to steady the opposite end 32 of the apparatus. The painting arm is then steadied by placing it on the support member 12 portion of the apparatus.

By utilizing a hook and eyelet attachment means for the apparatus, the position of the apparatus is easily adjusted for reaching various positions of the canvas 28 without having to disconnect or change the attachment of the apparatus.

In another embodiment of the subject invention (not illustrated), the apparatus for steadying one's arm at an easel can be used with a table easel. The main difference in this case is that one eyelet is provided at the top of the table easel where the canvas attaches. The apparatus is attached to this eyelet utilizing the hook means.

Although a preferred embodiment has been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A system for steadying one's arm at an easel comprising:

an easel having a face and a back, said easel one or more eyelets located on the face thereof;

a support member having two ends; and hook means located at one end of said support member, said hook means capable of being inserted into one of said eyelets; wherein when said hook means is inserted into one of said eyelets, and the other end of said support member is supported by one of an artist's hands, the other of said artist's hands is capable of being steadied at said easel by said support member.

2. A method of steadying an arm at an easel which comprises:

a) attaching an apparatus to a top of an easel, said apparatus comprising a support member having two ends and hook means located at one end of said support member, said attachment comprising inserting said hook means into an eyelet located on top of said easel;

b) holding the other end of said support member; and c) steadying an arm at the easel by placing said arm on said support member.

* * * * *

UNITED STATES PATENT AND TRADEMARK OFFICE

CERTIFICATE OF CORRECTION

PATENT NO. : 5,141,198

DATED : Aug. 25, 1992

INVENTOR(S) : Marion E. Hoyt

It is certified that error appears in the above-identified patent and that said Letters Patent is hereby corrected as shown below:

Column 3,

In claim 1, line 9, after "said easel" add--having--.

Signed and Sealed this

Fourteenth Day of September, 1993

*Attest:*

*Attesting Officer*

BRUCE LEHMAN

*Commissioner of Patents and Trademarks*